US008312748B2

(12) United States Patent
Bundy

(10) Patent No.: US 8,312,748 B2
(45) Date of Patent: Nov. 20, 2012

(54) DEADBOLT ACTUATION LEVER BLOCKER APPARATUS

(76) Inventor: Kent F. Bundy, Sioux Falls, SD (US)

( * ) Notice: Subject to any disclaimer, the term of this patent is extended or adjusted under 35 U.S.C. 154(b) by 795 days.

(21) Appl. No.: 12/221,619

(22) Filed: Aug. 5, 2008

(65) Prior Publication Data

US 2010/0031715 A1 Feb. 11, 2010

(51) Int. Cl.
*E05B 13/00* (2006.01)

(52) U.S. Cl. ..... 70/416; 70/429; 70/450

(58) Field of Classification Search ..... 70/416, 70/450, 452, 211, 429, 430; 292/258, 288, 292/339

See application file for complete search history.

(56) References Cited

U.S. PATENT DOCUMENTS

| | | | | | |
|---|---|---|---|---|---|
| 3,423,974 | A | * | 1/1969 | Bernsley | 70/416 |
| 3,748,882 | A | * | 7/1973 | Dusault et al. | 70/416 |
| 3,921,423 | A | | 11/1975 | Hollins | |
| 4,152,911 | A | * | 5/1979 | Sharma | 70/416 |
| 4,279,137 | A | | 7/1981 | Cook | |
| 4,397,168 | A | * | 8/1983 | Rotondi et al. | 70/417 |
| 4,673,202 | A | | 6/1987 | Willis | |
| 4,801,163 | A | | 1/1989 | Miller | |
| 4,947,663 | A | * | 8/1990 | Yeager | 70/416 |
| 5,052,202 | A | | 10/1991 | Murphy | |
| 5,067,334 | A | | 11/1991 | Sorkilmo | |
| 5,313,812 | A | * | 5/1994 | Eklund et al. | 70/416 |
| 5,369,971 | A | * | 12/1994 | Sheppard | 70/416 |
| 5,515,704 | A | * | 5/1996 | van Nguyen | 70/416 |
| 5,651,279 | A | | 7/1997 | Berton et al. | |
| 5,950,465 | A | * | 9/1999 | Schultz et al. | 70/416 |
| 6,301,941 | B1 | | 10/2001 | Nicholsfigueiredo | |
| 6,578,888 | B1 | | 6/2003 | Fayngersh | |
| 6,993,944 | B2 | | 2/2006 | Hicks | |
| 7,216,903 | B1 | | 5/2007 | Kent et al. | |
| 2004/0107752 | A1 | | 6/2004 | Hicks | |
| 2005/0185393 | A1 | | 8/2005 | Eller | |
| 2005/0193787 | A1 | | 9/2005 | Davis | |
| 2007/0033973 | A1 | | 2/2007 | Kosi | |
| 2007/0107479 | A1 | | 5/2007 | Robertson | |
| 2009/0235704 | A1 | * | 9/2009 | Quach | 70/416 |

OTHER PUBLICATIONS

The International Bureau of WIPO, International Preliminary Search Report on Patentability (Chapter of the Patent Cooperation Treaty), Communication from WIPO, Feb. 17, 2011, Geneva, Switzerland.

* cited by examiner

*Primary Examiner* — Christopher Boswell
(74) *Attorney, Agent, or Firm* — Jeffrey A. Proehl; Woods, Fuller, Shultz & Smith, P.C.

(57) ABSTRACT

A blocking apparatus is disclosed for selectively blocking movement of a deadbolt actuation lever on a door. The apparatus includes a base mounting plate for mounting on the door, the base mounting plate including an engaging portion for positioning against the inside surface of the door and a deadbolt receiving portion for positioning against the edge surface of the door. The apparatus also includes a mounting shaft mounted on and extending from the engaging portion and a blocking member mounted on the mounting shaft and movable between a block position and an unblocked position. The block position is characterized by the blocking member blocking movement of the deadbolt actuation lever from the locked orientation to the unlocked orientation. The unblocked position of the blocking member is characterized by the deadbolt actuation lever being free to move without interference by the blocking member.

16 Claims, 3 Drawing Sheets

DEADBOLT ACTUATION LEVER BLOCKER APPARATUS

BACKGROUND OF THE INVENTION

1. Field of the Invention

The present invention relates to apparatus for securing doors to prevent entry, and more particularly pertains to a new deadbolt actuation lever blocker apparatus for securing a deadbolt actuation lever and a deadbolt in the locked position.

2. Description of the Prior Art

In all residential and commercial settings, the concept of securing persons such as oneself, loved ones, and employees is of paramount importance. As advances in technology and the availability of information make it easier to thwart locking mechanisms on doors in homes, hotel rooms and offices, a need has developed for a portable device to positively secure a door. In some instances, individuals may desire the security of a locking mechanism that allows outside entry in some situations but prevents outside entry in other situations.

Traditional doorknobs with integrated locking mechanisms employ a spring-loaded bolt which may be retracted with minimal pressure. Typically, no mechanism positively "locks" the bolt in a closed position. The action of locking a traditional doorknob engages a lock cylinder to prevent the knob or lever from being turned, thereby preventing the bolt from being retracted using the knob. Even by preventing the knob from turning, doors secured by these traditional doorknobs can be opened using a thin, rigid object inserted between the door and the frame to press against and retract the bolt into the door.

In order to overcome these problems, deadbolt locking mechanisms, in contrast, do not employ spring-loaded bolts, relying instead on a direct connection between the deadbolt's lock cylinder and the bolt itself. In order to retract or extend the bolt, the lock cylinder must be turned. Although deadbolt locking mechanisms have security advantages over traditional doorknobs with integrated locking mechanisms, exterior access to the lock cylinder still permits an individual to disengage the deadbolt with a key or through the process of lock-picking. Certain deadbolt locking mechanisms are of the exit-only type, and do not have exterior access to the lock cylinder. These exit-only deadbolts may be locked and unlocked only from one side of a door, making them unsuitable for securing a door which is used to both enter and exit property. Without access to the interior of a door, the deadbolt locking mechanism may not be engaged. Door chains and hinged locks commonly found in apartments and hotel rooms also suffer from this limitation.

Furthermore, apartments and hotels commonly maintain master keys which open any door in a particular facility. Although commonly used for tasks such as maintenance and cleaning, these master keys present a security risk to occupants who desire no access to their person or belongings. In addition to master keys, unknown or unaccounted duplicate keys held by previous tenants, residents or guests may also jeopardize security from outside entry.

A number of apparatus have been proposed that provide a locking mechanism which may only be operated from one side of the door. Known apparatus all require some type of permanent modification of, or attachment to, a door. The user of a door chain or a hinged lock, for example, must affix a portion of the chain or lock on the door and an adjacent location on the door frame. Modification of, or attachment to a door is not always permitted or convenient, however.

In these respects, the deadbolt actuation lever blocker apparatus according to the present invention substantially departs from the conventional concepts and designs of the prior art, and in so doing provides an apparatus highly effective for securing a deadbolt actuation lever and a deadbolt in the locked position, thereby preventing outside entry, even with a key.

SUMMARY OF THE INVENTION

In view of the foregoing disadvantages inherent in the known types of apparatus for securing doors to prevent entry present in the prior art, the present invention provides a new deadbolt actuation lever blocker apparatus for securing a deadbolt actuation lever and a deadbolt in the locked position.

While the devices known in the art offer various solutions to the broad issue of securing a door from outside entry, no known device allows a user to prevent outside entry through virtually any door having a deadbolt with an actuation lever located on the interior of the door.

To attain this, the present invention generally comprises a blocking apparatus for selectively blocking movement of a deadbolt actuation lever on a door. The apparatus includes a base mounting plate for mounting on the inside surface of a door, a blocking member for blocking the actuation of the deadbolt actuation lever with the blocking member being mounted on the base mounting plate, and a knob for facilitating the pivoting movement of the blocking member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage that may be provided by the deadbolt actuation lever blocker apparatus of the present invention is the configuration of the base mounting plate for mounting to various doors having deadbolt locking mechanisms without requiring permanent attachment steps.

Another significant advantage that may be provided by the present invention is the ability to move the apparatus from door to door, securing virtually any door with a deadbolt from being unlocked without access to the interior side of the door.

Yet another significant advantage that may be provided by the present invention is its ability to be adapted for mounting to either a right-hand opening door or a left-hand opening door.

A further advantage that may be provided by the present invention is its compact size, making it both convenient for storage when not in use and convenient to pack when traveling.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
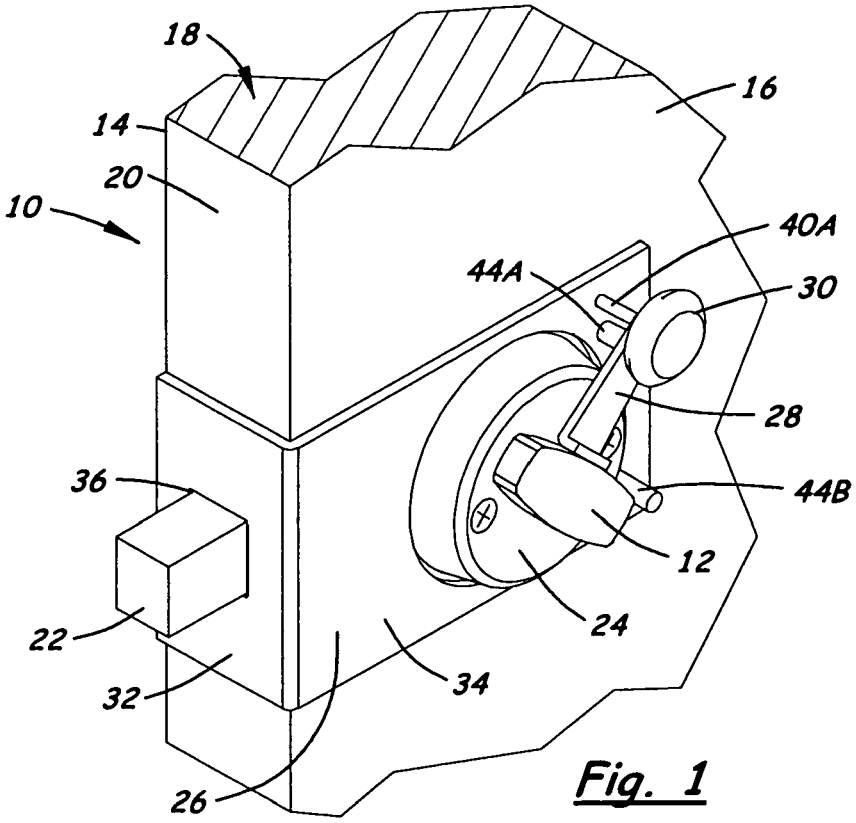
FIG. 1 is a schematic perspective view of the present invention, showing the blocking apparatus mounted to a left-hand opening door. The apparatus is shown in an engaged position, such that the deadbolt is extended and received by the deadbolt receiving portion. The faceplate receiving aperture is located about the deadbolt face plate, and the stop member is shown blocking the deadbolt actuation lever.

With reference now to the drawings, and in particular to FIGS. 1 through 5 thereof, a new deadbolt actuation lever blocker apparatus embodying the principles and concepts of the present invention and generally designated by the reference numeral 10 will be described.

Figure 2:
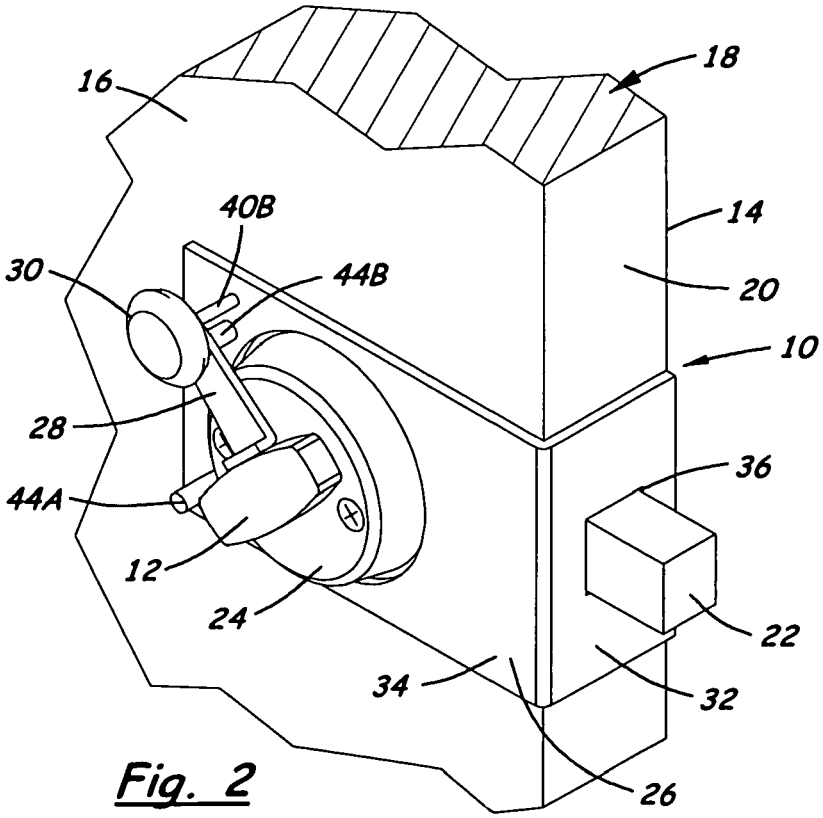
FIG. 2 is a schematic perspective view of the present invention, showing the blocking apparatus mounted to a right-hand opening door. The apparatus is shown in an engaged position, such that the deadbolt is extended and received by the deadbolt receiving portion. The faceplate receiving aperture is located about the deadbolt face plate, and the stop member is shown blocking the deadbolt actuation lever.

In FIG. 1, the primary components of the deadbolt actuation lever blocker apparatus 10 are shown mounted to a left-hand opening door. In FIG. 2, the primary components of the same apparatus 10 are shown mounted to a right-hand opening door. The apparatus 10 is used for selectively blocking the movement of a deadbolt actuation lever 12 on a door 14 so that the deadbolt cannot be disengaged with a key or through lock picking. The apparatus 10 mounts to a door 14 having an inside surface 16, an outside surface 18, and an edge surface 20 extending between the inside 16 and outside 18 surfaces. The deadbolt assembly 20 includes a deadbolt 22 extendable from and retractable into the edge surface 20 of the door 14. The deadbolt assembly 20 further includes a deadbolt face plate 24, with the deadbolt actuation lever 12 being mounted on the deadbolt face plate 24.

The apparatus 10 generally comprises a base mounting plate 26 for positioning adjacent to or against the inside surface of a door, a blocking member 28 for blocking the actuation of the deadbolt actuation lever 12, and a knob 30 for positioning the blocking member about the deadbolt actuation lever 12.

Figure 3:
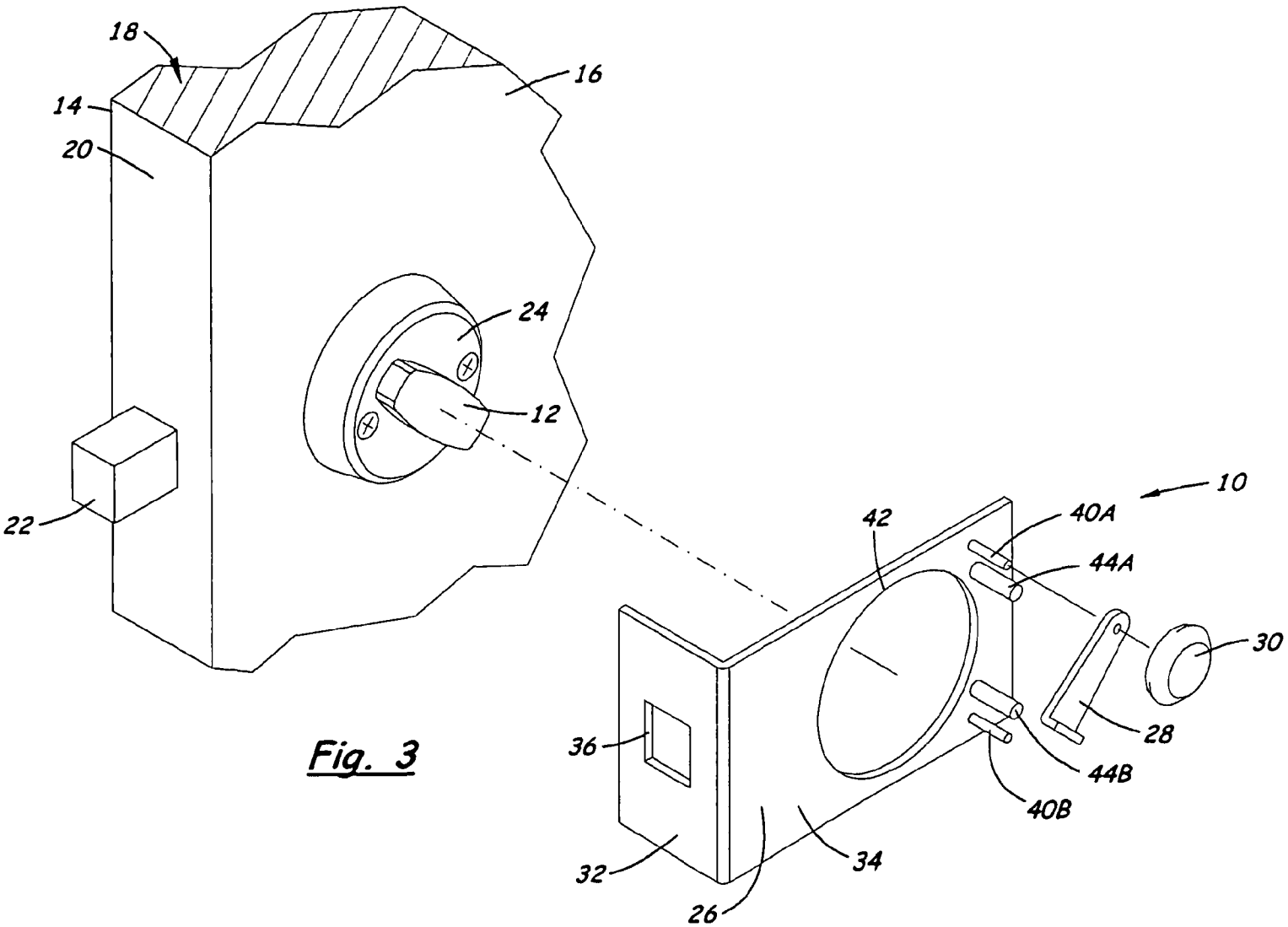
FIG. 3 is an exploded schematic perspective view of the present invention, illustrating one configuration of the apparatus' components.

In FIG. 3, the base mounting plate 26 is shown. The plate 26 has a deadbolt receiving portion 32 and an engaging portion 34 for engaging the deadbolt face plate 24. The plate 26 also contains one or more mounting shafts 40 for receiving a blocking member 28. Although the plate 26 is termed a mounting plate, it should be recognized that no permanent mounting of the plate 26 is necessary for the function of the apparatus 10.

The deadbolt receiving portion 32 may be positioned adjacent to or against the edge surface 20 of the door 14 for receiving the deadbolt 22 when the deadbolt is extended from the edge surface 20 of the door 14. The deadbolt receiving portion 32 may be substantially rectangular in shape, having a width, a height and a depth. The deadbolt receiving portion 32 may have an aperture 36 for receiving a deadbolt when it is extended from the edge surface of the door. Illustratively, the deadbolt receiving portion may be 1¾ inches wide, 3 inches tall, and ⅛ of an inch deep in order to fit on doors of typical dimensions and mountings, although other dimensions could employed without departing from the disclosure. In a preferred embodiment, the width of the deadbolt receiving portion 32 should be sized so as not to be substantially greater than the width of the edge surface 18 of the door 14. Also in the preferred embodiment, the height of the deadbolt receiving portion 32 should be great enough to accommodate the aperture 36 for receiving the deadbolt 22 with sufficient material around the aperture so that the material surrounding the aperture 36 is of sufficient strength to prevent removal of the apparatus 10 without disengaging it. Illustratively, the aperture 36 may be substantially rectangular in shape. In order to accommodate a typical deadbolt, the aperture may be ¾ inches wide and ⅞ inches tall. The aperture 36 may be located in a substantially central position on the deadbolt receiving portion 32.

Figure 4:
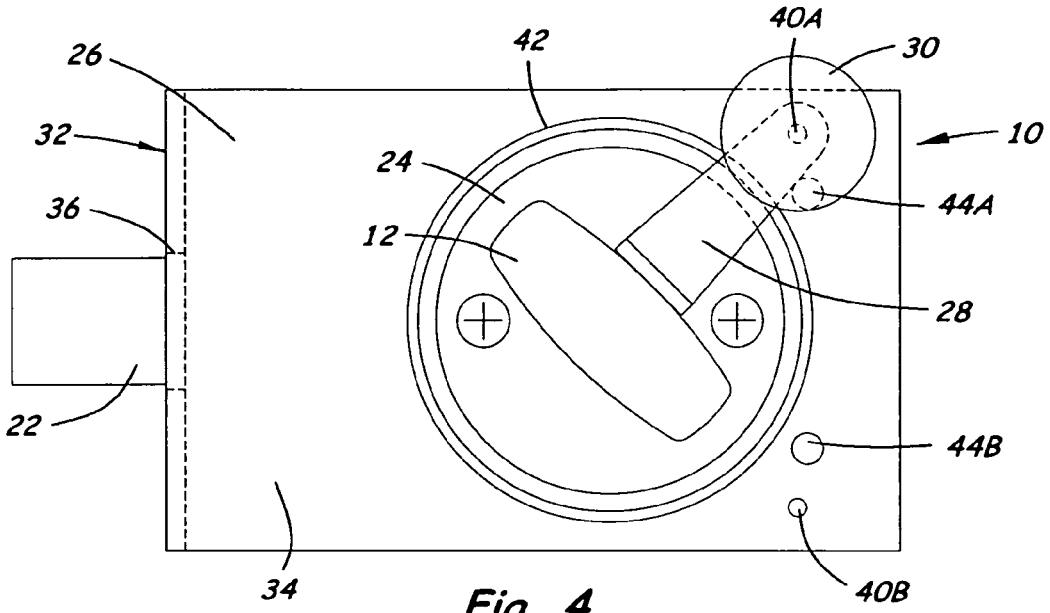
FIG. 4 is a schematic front view of the present invention, showing the blocking apparatus mounted to a left-hand opening door. The apparatus is shown in an engaged position, such that the deadbolt is extended and retained by the apparatus. The stop member is shown blocking the deadbolt actuation lever, preventing the lever from being turned, and, consequently, the door from being unlocked.
Figure 5:
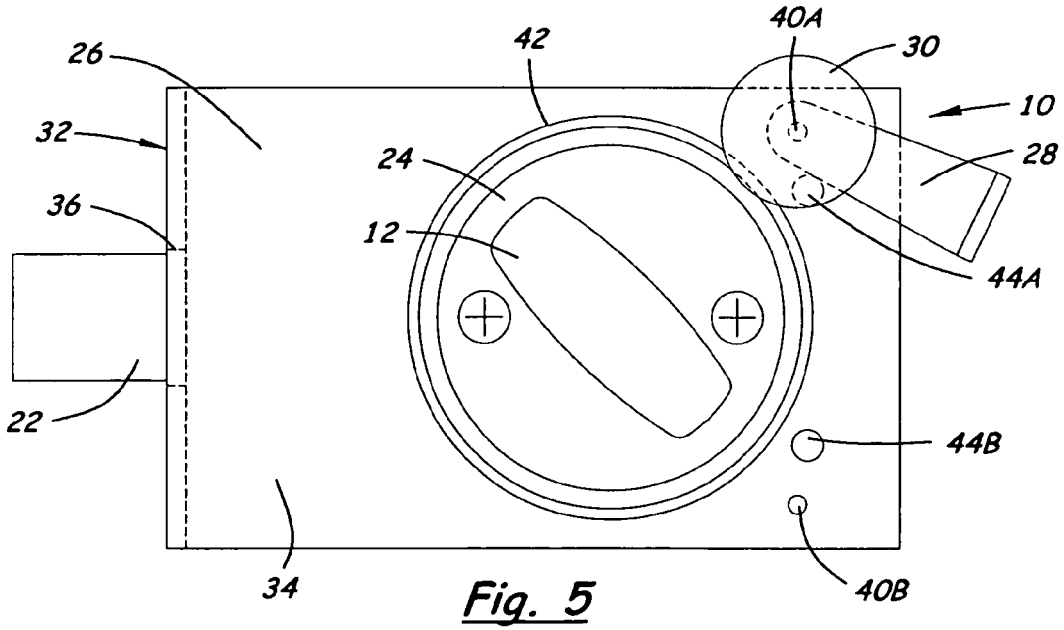
FIG. 5 is a schematic front view of the present invention, showing the blocking apparatus mounted to a left-hand opening door. The apparatus is shown in a disengaged position, such that the deadbolt is extended and retained by apparatus but the stop member is not shown blocking the deadbolt actuation lever. In this configuration, the deadbolt actuation lever can be turned so that the deadbolt may be retracted.

FIGS. 4 and 5 show a front view of the blocking apparatus 10 mounted on a left-hand opening door. The engaging portion 34, which mounts about the deadbolt face plate 24, may have a substantially rectangular configuration with a width, a height and a depth. The width and height of the engaging portion 34 should be great enough to accommodate an aperture 42 for receiving the face plate 24 of the deadbolt actuation lever 12. Illustratively, the engaging portion 34 may be 4¾ inches wide, 3 inches tall, and ⅛ of an inch thick, although other dimensions could employed without departing from the disclosure. The width of the engaging portion 34 should be sufficient so that one edge of the portion 34 may be connected to an edge of the deadbolt receiving portion 32, and the other edge of the portion 34 extends past the deadbolt 22.

Illustratively, the aperture 42 for receiving the face plate 24 has a substantially circular shape, although this shape is not critical to the function of the apparatus 10. In order to accommodate face plates 24 of typical sizes, one highly useful size of the aperture 42 is 2⅝ inches in diameter, although other dimensions could employed without departing from the disclosure.

The deadbolt receiving portion 32 and the engaging portion 34 may be fastened together about one edge, such that a perpendicular cross section of the plate 26 has a substantially L-shaped appearance. The portions 32 and 34 may be fastened so that the plane of the engaging portion 34 is perpendicular to the plane of the deadbolt receiving portion 32, resulting in the plate 26 being positionable along the edge surface 20 and the inside surface 16 of the door 14. In the preferred embodiment, this fastening may occur about a vertical edge of the base mounting plate 26. The fastening of the deadbolt receiving portion 32 and the engaging portion 34 may be integral, such that the entire base mounting plate 26 is constructed of a single, integral piece of material and is thus inseparable without destroying the plate 26. Optionally, the deadbolt receiving portion 32 and the engaging portion 34 may be fastened with a non-integral method, where the deadbolt receiving portion 32 and the engaging portion 34 are constructed separately and connected together with a fastening means. The fastening means may include nailing, gluing, braising, welding, or soldering, but should be sufficiently strong to avoid separation of the portions.

One or more mounting shafts 40 may be located on the engaging portion 34 for receiving the blocking member 28. The mounting shafts 40 may extend outwardly from the plate and may be located at more than one location to provide alternative mounting points for the blocking member 28, so that the apparatus 10 may be used on both right hand opening and left hand opening doors. Illustratively, the apparatus 10 may include a first mounting shaft 40A and a second mounting shaft 40B. Each mounting shaft 40 may have an elongate structure with a proximal end and a distal end. Each shaft 40 may attach to the engaging portion 34 at the distal end. The proximal end of the shafts 40 may be configured to receive a knob 30 in a manner that permits the knob to rotate with respect to the shaft 40.

The blocking member 28 is able to block the actuation of the deadbolt actuation lever depending upon the position of the member 28. The blocking member 28 may be movable with respect to the base mounting plate 26 between a block position (see FIG. 4) and an unblocked position (see FIG. 5). The block position may be characterized by the blocking member 28 being able to block movement (such as, for example, rotation) of the deadbolt actuation lever from the locked orientation to the unlocked orientation when the blocking apparatus is mounted on the door. The unblocked position of the blocking member 28 may be characterized by the deadbolt actuation lever being free to move (e.g., rotate) without interference by or from the blocking member when the blocking apparatus is mounted on the door, and may be a discrete position or a plurality of positions. Illustratively, the blocking member 28 may comprise an elongate arm, having a proximal end and a distal end that is pivotally connected to the base mounting plate. One end of the blocking member 28 may include an aperture for receiving one of the mounting shafts 40 on the base mounting plate 26. The blocking member 28 may be pivotally secured to the mounting shaft 40 so that the member 28 may be pivoted in a plane that is substantially parallel to the plane of the base mounting plate 26, and particularly the deadbolt receiving portion 32 of the plate 26. In an illustrative embodiment, the blocking member 28 may be pivotally secured to one of the mounting shafts 40 so that the member 28 may be pivoted in a plane that is substantially parallel to the plane of the inside surface 16 of a door 14, when the apparatus 10 is mounted on a door 14. The blocking member 28 may be located closer to the side edge of the base mounting plate 26 than the faceplate receiving aperture 42. The blocking member 28 may be positioned on the base mounting plate 26 such that it is located vertically higher than the faceplate receiving aperture 42 when the plate is mounted on a door 14. In apparatus 10 including a pair of the mounting shafts 40A and 40B, the blocking member 28 may be mounted on the mounting shaft 40 that is located at a vertical level higher than the aperture 42 when the apparatus 10 is mounted on a door.

A stop member 44 may be located on the engaging portion for limiting the movement of the blocking member 28. The stop member 44 may be located on the engaging portion 34 such that when the blocking member 28 is rotated in a first rotational direction, the stop member stops the blocking member in the block position (see FIG. 4) and when the blocking member is rotated in a second rotational direction (opposite of the first rotational direction), the stop member stops the blocking member in the unblocked position (see FIG. 5). The stop member 44 may include any structure suitable for limiting the movement of the blocking member 28, and may extend outwardly from the face of the base mounting plate 26. Optionally, a stop member 44A may be included in a position that corresponds to the location of the mounting shaft 40A, and a stop member 44B may be included in a position that corresponds to the location of the mounting shaft 40B (see FIGS. 4 and 5).

The knob 30 is mounted on the mounting shaft 40, and may be used to facilitate the pivoting movement of the blocking member 28. Illustratively, the knob 30 is used to retain the blocking member 28 to the mounting shaft 40 so that the blocking member 28 may pivot in a plane parallel to the plane of the engaging portion 34.

The apparatus 10 may be constructed of a rigid material, such as a rigid plastic or a rigid metal. The base mounting plate 24 may be constructed of a suitably strong material that resists destruction. Optionally, portions of the apparatus 10 may be constructed of or coated with a visibility enhancing material for enhancing the visibility of the apparatus 10 in environments with low levels of light. Illustratively, the visibility enhancing material may comprise a reflective material or a self-illuminating material. In one embodiment, the blocking member 28 may be constructed of or coated with a visibility enhancing material so that the member 28 is more visible in the dark.

When the blocking apparatus 10 is mounted to a door 14 and a deadbolt 22 is extended through the deadbolt receiving portion 32, the deadbolt receiving portion 32 supports the apparatus 10 at a vertical position determined by the height of the deadbolt 22. Likewise, when the blocking apparatus 10 is mounted to a door 14 and the engaging portion 34 surrounds a deadbolt face plate 24, the engaging portion 34 supports the apparatus 10 at a vertical position determined by the height of the deadbolt face plate 24. When the apparatus 10 is mounted to a door 14, a deadbolt 22 is extended through the deadbolt receiving portion 32, and the engaging portion 34 surrounds a deadbolt face plate 24, the apparatus 10 cannot be removed from the door 14 unless the deadbolt 22 is retracted. Once retracted, the blocking apparatus 10 may be moved from door to door in order to secure any area where access is controlled by a door 14 having a deadbolt 22.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system comprising:

a door having an inside surface, an outside surface, and an edge surface extending between the inside and outside surfaces;

a deadbolt assembly comprising:

a deadbolt extendable from and retractable into the edge surface of the door;

a deadbolt face plate;

a deadbolt actuation lever mounted on the deadbolt face plate and being rotatable about a rotation axis between a locked orientation and an unlocked orientation;

a blocking apparatus for selectively blocking movement of the deadbolt actuation lever on the door, the blocking apparatus comprising:

a base mounting plate mounted on the door, the base mounting plate comprising:

an engaging portion positioned against the inside surface of the door, the engaging portion including a first aperture receiving the deadbolt face plate; and a deadbolt receiving portion positioned against the edge surface of the door, the engaging portion including a second aperture receiving the deadbolt when the deadbolt is extended from the edge surface of the door;

a mounting shaft mounted on and extending from the engaging portion of the base mounting plate; and a blocking member mounted on the mounting shaft and being movable between a block position and an unblocked position, the block position being characterized by the blocking member blocking movement of the deadbolt actuation lever from the locked orientation to the unlocked orientation when the blocking apparatus is mounted on the door, the unblocked position of the blocking member being characterized by the deadbolt actuation lever being free to move without interference by the blocking member when the blocking apparatus is mounted on the door;

wherein the second aperture in the deadbolt receiving portion is configured such that extension of the deadbolt from the door and through the second aperture supports the blocking apparatus on the door in a position such that the deadbolt receiving portion surrounds the deadbolt face plate and retraction of the deadbolt into the door permits removal of the blocking apparatus from the door;

wherein the first aperture of the engaging portion is configured such that the engaging portion does not contact the deadbolt face plate to permit removal of the blocking apparatus from the door when the deadbolt is retracted into the door.

2. The system of claim 1 wherein the second aperture in the deadbolt receiving portion is configured such that extension of the deadbolt from the door and through the second aperture supports the blocking apparatus on the door in a position such that the deadbolt receiving portion surrounds the deadbolt face plate and retraction of the deadbolt into the door permits removal of the blocking apparatus from the door.

3. The system of claim 1 wherein the blocking member is configured so that, in the block position, the blocking member contacts the deadbolt actuation lever at a single location.

4. The system of claim 1 wherein the blocking member is configured so that the blocking member is biased to rotate into the block position by gravity acting on the blocking member to abut against the deadbolt actuation lever.

5. The system of claim 1 wherein the blocking member is configured so that the blocking member is biased to rotate into the block position by gravity acting on the blocking member to abut against the deadbolt actuation lever when the blocking member is rotated toward the block position, and is biased to rotate into the unblocked position by gravity acting on the blocking member when the blocking member is rotated toward the unblocked position.

6. The system of claim 1 wherein the engaging portion is connected to the deadbolt receiving portion so that the plane of the engaging portion is perpendicular to the plane of the deadbolt receiving portion such that the plate is positionable along two perpendicular surfaces of the door.

7. The system of claim 1 wherein the blocking member is removably mounted on the mounting shaft, the mounting shaft being positioned on the engaging portion in a location that permits the blocking member to selectively block movement of the deadbolt actuation lever on a first one of a right-hand or left-hand opening door, and additionally comprising a second mounting shaft mounted on the engaging portion of the base mounting plate, the blocking member being removably mountable on the second mounting shaft to position, the second mounting shaft being positioned on the engaging portion in a location that permits the second blocking member to selectively block movement of the deadbolt actuation lever on a second one of a right-hand or left-hand opening door.

8. The system of claim 1 additionally comprising a stop member extending outwardly from the face of the base mounting plate and being positioned on the engaging portion such that the stop member limits movement of the blocking member.

9. The system of claim 8 wherein the stop member is positioned on the engaging portion such that the stop member contacts the blocking member when the blocking member is in the block position.

10. The system of claim 1 wherein the blocking member comprises an elongate arm having proximal and distal ends, the elongate arm having an aperture receiving the mounting shaft.

11. The system of claim 1 wherein the blocking member is pivotally mounted on the mounting shaft so that the blocking member is pivotable between the block position and the unblocked position.

12. The system of claim 1 wherein the blocking member is pivotally mounted on the mounting shaft so that the blocking member is pivotable in a plane that is substantially parallel to the plane of the inside surface of the door when the apparatus is mounted on the door.

13. The system of claim 1 additionally comprising a visibility enhancing material disposed on the blocking member for enhancing the visibility of the blocking member in environments with low levels of light.

14. The system of claim 13 wherein the visibility enhancing material comprises a reflective material.

15. The system of claim 13 wherein the visibility enhancing material comprises a self-illuminated material.

16. The system of claim 1 wherein the mounting shaft is positioned on the engaging portion of the base mounting plate so that the blocking member, when mounted on the mounting shaft, is located at a vertically higher position than the first aperture when the base mounting plate in mounted on the door.

* * * * *